US006568545B2

(12) United States Patent
Feder

(10) Patent No.: US 6,568,545 B2
(45) Date of Patent: May 27, 2003

(54) SHIPPING HANGER

(75) Inventor: Harold Feder, Carlstadt, NJ (US)

(73) Assignee: RHE Container Co., Inc., Carlstadt, NJ (US)

( * ) Notice: Subject to any disclaimer, the term of this patent is extended or adjusted under 35 U.S.C. 154(b) by 0 days.

(21) Appl. No.: 09/832,465

(22) Filed: Apr. 12, 2001

(65) Prior Publication Data

US 2002/0148797 A1 Oct. 17, 2002

(51) Int. Cl.[7] ..... A47F 5/00
(52) U.S. Cl. ..... 211/124; 206/291
(58) Field of Search ..... 211/123, 124, 211/7, 8; 206/279, 290, 291

(56) References Cited

U.S. PATENT DOCUMENTS

| | | | | |
|---|---|---|---|---|
| 1,439,145 A | | 12/1922 | Cazier et al. | |
| 1,779,730 A | | 10/1930 | Brunson | |
| 2,796,977 A | | 6/1957 | Divine | |
| 3,112,027 A | | 11/1963 | Field et al. | |
| 3,349,923 A | * | 10/1967 | Feder | 211/123 |
| 3,380,596 A | * | 4/1968 | Crowl | 211/123 |
| 3,421,614 A | | 1/1969 | Crane | |
| 3,633,760 A | | 1/1972 | Vosbikian | |
| 3,902,597 A | | 9/1975 | Brennan | |
| 3,991,884 A | | 11/1976 | DaMaaged et al. | |
| 3,993,195 A | * | 11/1976 | Caligiuri | 211/7 |
| 4,293,076 A | | 10/1981 | Collin | |
| 4,396,124 A | * | 8/1983 | Feder | 211/124 |
| 4,760,929 A | | 8/1988 | Fedorchak | |
| 4,811,853 A | | 3/1989 | Mead et al. | |
| 5,702,010 A | | 12/1997 | Liang | |

* cited by examiner

*Primary Examiner*—Robert W. Gibson, Jr.
(74) *Attorney, Agent, or Firm*—Stephen E. Feldman

(57) ABSTRACT

A hanger bar structure to span across the upper portion of a wardrobe shipping carton that is used to transport garments hung on hangers, particularly new garments shipped from manufactures. The hanger bar is rectilinear with a plurality of slots on its flat upper surface. The size of the slots, the spacing between the slots, and the arcuate shape of the wire hooks at the tops of the hangers is such that a group of garment-laden hangers can be hung at one loading and then slid along the top of the bar to drop individually into slots.

15 Claims, 1 Drawing Sheet

FIG. 3

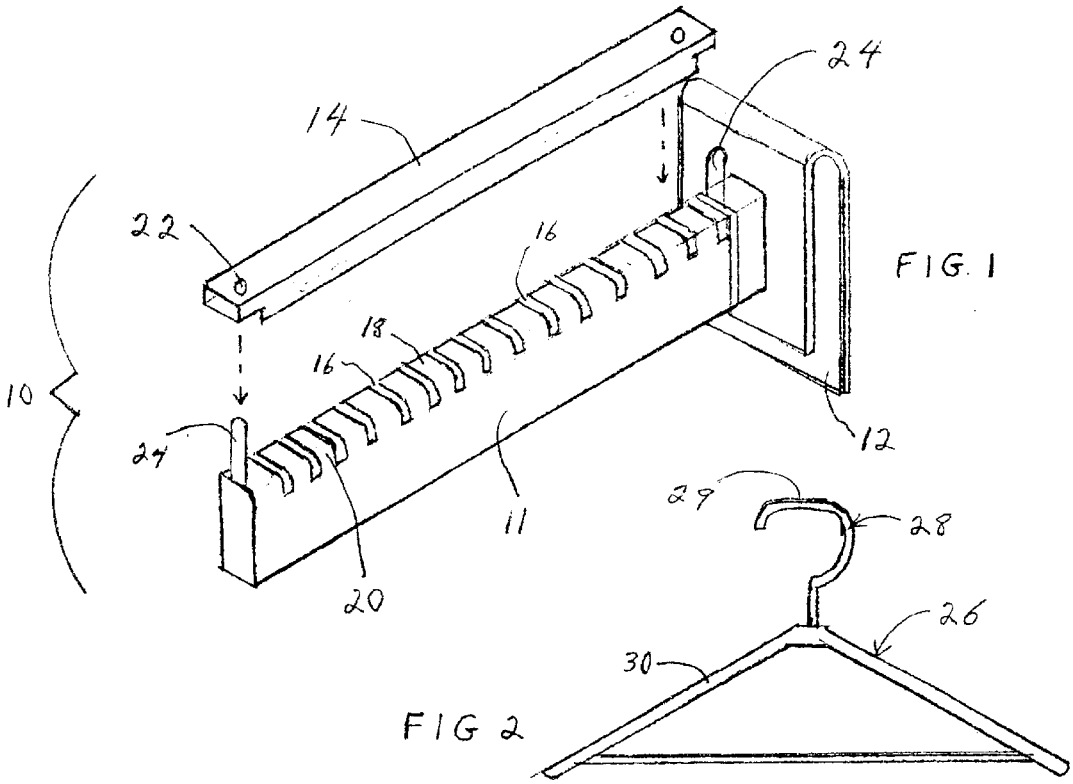
FIG. 1
FIG 2
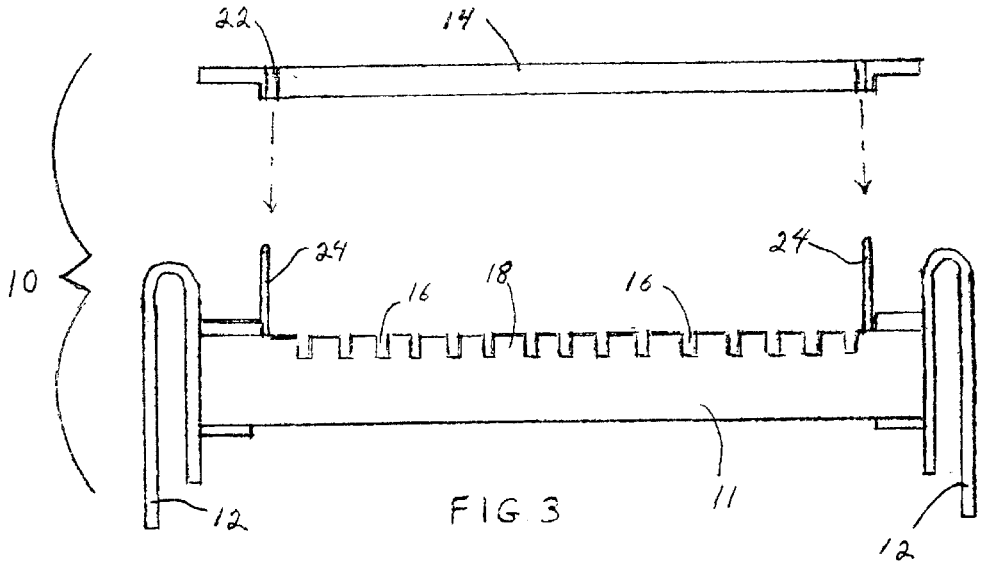
FIG. 3

SHIPPING HANGER

BACKGROUND OF THE INVENTION

1. Field of the Invention

The present invention relates to shipping containers, particularly to shipping containers for new clothing being shipped from manufactures. Such garments, like men's suits, are usually initially pressed and hung on suit hangers in the factory. When they are shipped, they are shipped on those same hangers, but the hangers are hung from a hanger bar of a hanger bar assembly in a wardrobe carton. These cartons must be loaded with garments as rapidly as possible since it is part of the production process to get them shipped and into the distribution chain. At the same time, it is necessary to avoid wrinkling of the newly pressed garments since unnecessary extra cost would be incurred in re-pressing. Problems usually occur either because the garment hangers come off the hanger bar assembly or because they slide sideways on the hanger bar. Thus the hanger bar assembly in the wardrobe carton is of prime importance since it must have a means to keep the garments secure and evenly spaced on the bar and separated, but at the same to enable rapid loading of the main bar of the hanger bar assembly. Separation is best achieved by groves or slots in the main bar so each hanger will have a home slot. But such grooves or slots in the prior art have interfered with rapid loading because hangers cannot be slid along the bar and thus it is necessary to load the hangers individually or in very small quantities.

2. Description of the Prior Art

The patents to Vosbikian (U.S. Pat. No. 3,633,760) and Collin (U.S. Pat. No. 4,293,076) each disclose a stamped metal channel bar which has end brackets for fitting over the upstanding edges of a wardrobe carton. Each has a locking bar for holding the tops of hangers in place but there is no means for assuring even spacing between the hangers. U.S. Pat. No. 3,902,597 to Brennan also has a metal channel with brackets to support it on a wardrobe carton but in Brennan the main bar has a series of nibs pressed upwardly from the bar to form separator slots for the garment hangers. Such upward projections have been found to prevent a plurality of hangers from being loaded at one time and subsequently being slid along the bar, but are effective to prevent hangers from sliding sideways after they are finally individually positioned.

Fedorchak U.S. Pat. No. 4,760,929 teaches a sleeve-like body emplaceable over a clothes rod and having a series of relatively narrow upwardly projecting partitions to separate hangers. The patent to Mead (U.S. Pat. No. 4,811,853) has a main bar with cut-in slots for hangers and a hold-down bar which is pivoted at the center of the top of the main bar and would thus interfere with sliding of hangers across the top of the main bar.

SUMMARY OF THE INVENTION

The present invention is directed to a hanger bar assembly for a garment shipping wardrobe carton, that assembly includes a main bar having a plurality of slots or grooves in the upper surface thereof. That upper flat surface is smooth and planar with a width of about ¾ of an inch, which is approximately, equal to the width of a flattened area on the upper end of an otherwise arcuately shaped wire hook on a hanger which will be hung from the main bar. The smooth and planar upper surface, along with a spacing between adjacent slots of a width which is at least twice the width (thickness) of a hook wire, makes it easy to slide wire hanger hooks along the main bar so as to distribute the hangers along the main bar with each hook of a group of hangers dropping sequentially into a slot as the group of hanger is slid along the upper surface of the main bar.

BRIEF DESCRIPTION OF THE DRAWINGS

FIG. 1 is an exploded perspective view of a hanger bar assembly with its hold-down bar elevated from the main bar and one end support omitted for clarity;

FIG. 2 is a front elevational view of a typical hanger used in connection with the hanger bar assembly of FIG. 1; and FIG. 3 is an exploded front elevational view of the hanger bar assembly of FIG. 1, but with both end supports in place.

DETAILED DESCRIPTION OF THE INVENTION

Referring to the drawings, FIG. 1 shows a hanger bar assembly 10 with a main bar 11 and an attached end support 12. This end support may be of the type disclosed in Assignee's U.S. Pat. No. 4,396,124 issued Aug. 2, 1983 and titled "Hanger Bar", the entire disclosure of which is hereby incorporated by reference. In FIG. 1 the left end support 12 has been omitted to have a better view of details; complete view with both end supports 12 in position is shown in FIG. 3.

As shown in FIG. 3 each end support 12 is an inverted U shape so that it may be fitted over an upstanding edge of a wardrobe carton wall. Such cartons, usually made of heavy duty corrugated cardboard, are of such a width that the two end supports 12 will fit over opposed walls of the carton, so that the hanger bar assembly 10 spans across the width of the carton at the top thereof. Thus garments on hangers placed on main bar 11 will hang down in the interior of the wardrobe carton. The main bar 11 is preferably made of wood and is of rectangular cross sectional shape with a smooth, planar upper surface having a plurality of transverse grooves or slots 16 cut in that upper surface to define flat surfaces 18 between the grooves 16. As shown in FIG. 1 the shoulders 20 on both longitudinal edges of bar 11 between the top surface 18 and the sidewall of bar 11 are slightly rounded. The transverse grooves or slots 16 extend across the width of bar FIG. 2 shows a typical hanger 26 of the type which would hold a garment to be supported from main bar 11. The hanger 26 has a body 30 shaped to hold a garment to be shipped and an upwardly projecting wire hook 28 having an arcuate shape, preferably with a slightly flattened area 29 along the top thereof. This flattened area 29 is not mandatory but is of assistance in being able to slide hangers along the top of main bar 11 as will be later explained.

Referring now to FIGS. 1 and 3, numeral 24 identifies a pair of resilient flexible metal tabs extending upwardly from main bar 11 or end support 12. After the desired number of slots 16 on main bar 11 have been filled with hangers, the hangers must be secured in place to prevent movement during shipping. This is accomplished by moving hold-down bar 14 downwardly into direct contact with the top of main bar 11 and/or the top(s) of the hanger hooks 28 that are in slots 16 and might be protruding above surface 18. This is variable depending upon the depth of slot 16, the diameter of hook wire 28 and whether or not a hook 28 has a flattened area at its top. As hold-down bar 14 is lowered, tabs 24 are inserted into openings 22 and after hold-down bar 14 is lowered as far as it can go, tabs 24 are bent over to retain bar 14 in its hold-down position. Tabs 24 are flexible not only so they can bent as just described, but also so they can be bent in the opposite direction, before the hold-down bar 14 is lowered, to keep the tabs out of the way when garment laden hangers are being loaded onto bar 11.

In an actual working embodiment the slots 16 were perpendicular to the longitudinal axis of bar 11 and were about 3/16 inches wide and about 5/32 inches deep with about a ½ inch planar surface 18 between adjacent slots; the diameter of the hook wire was about 5/32 inches thus the space 18 between adjacent slots 16 is more than twice the hook wire diameter. Of course other slot widths and spacings would work equally well but these dimensions are given for the sake of complete disclosure.

As previously stated, with the present invention it is possible to place a group of garment laden hangers on main bar 11 and successfully spread them rapidly across the bar 11 without difficulty, thus avoiding individual handling of the hangers and/or garments. It appears that the ease of this operation is caused at least partly because the distance between adjacent slots 16 is at least twice the diameter of a hook wire. This distance give the hooks 28 an opportunity to skew slightly diagonally across the top of bar 11 and prevents the hooks from dropping into slots until all of the hangers with their garments are on the bar 11. This consequently forces the hangers to assume a position in which all of the hooks 28 are perpendicular to the bar 11, apparently because the garments on the left and right ends of the bar contact the inside of the corresponding carton walls. Since the inside width of the hooks 28 is about 1½ inches and the width of the bar 11 is only about ¾ of an inch, the hooks are free to skew as described above, including sliding diagonally over one or more of the slots 16.

What is claimed is:

1. A hanger assembly configured for use in garment shipping boxes comprising:

a hanger bar assembly including a main bar made of wood and having opposing ends, the opposing ends defining a longitudinal axis and being connected to mounting means for fitting over opposed top edges of a wardrobe carton, the main bar spanning across the top of the wardrobe carton, the main bar having a smooth planar top surface and defining a plurality of slots generally perpendicular to the longitudinal axis, the hanger bar assembly further including attachment means extending outwardly from the main bar; and an elongate hold-down bar having opposing ends and configured for being removably positioned with the main bar, the hold-down bar having a stepped flat planar bottom surface configured for mating with the flat planar top stepped surface of the main bar, the hold-down bar being configured to securely connect with the attachment means.

2. The hanger bar assembly of claim 1, wherein the main bar has a rectilinear shape.

3. The hanger bar assembly of claim 2, wherein the main bar has rounded longitudinal edges.

4. The hanger bar assembly of claim 1, wherein the main bar is adapted for use with a plurality of hangers, each hangar including a hook configured for being positioned in one the slots of the main bar, the hooks having a generally arcuate shape, the generally arcuate shape portion defining an inside diameter and the straight portion being configured for sliding when in direct contact with the smooth planar top surface of the main bar, the main bar having a width in the direction perpendicular to the longitudinal axis of approximately half of the inside diameter of the hanger hook.

5. The hanger bar assembly of claim 4, wherein the slots in the main bar are separated by a distance of at least twice the thickness of the hanger hook.

6. The hanger bar assembly of claim 4, wherein the hook of the hangers includes a straight portion, the straight portion being generally parallel to the generally smooth planar top surface of the main bar, the distance of separation between the slots and the thickness of the main bar being configured for interfacing with the flat portion and arcuate portion of the hook for the sliding of hangers over the slots from one end to the opposing end during the loading of the hangers.

7. The hanger bar assembly of claim 1, wherein the mounting means and the attachment means are made of metal.

8. A hanger bar assembly and a plurality of hangers configured for use in garment shipping boxes comprising:

a hanger bar assembly including a main bar having a generally rectilinear shape and opposing ends, the opposing ends defining a longitudinal axis and being connected to mounting means for fitting over opposed top edges of a wardrobe carton so that the main bar spans across the top of the wardrobe carton, the main bar being fabricated of wood, having a smooth planar top surface, and defining a plurality of slots generally perpendicular to the longitudinal axis;

a plurality of hangers adapted for use with the hanger bar, each hanger including a hook configured for being positioned in one the slots of the main bar, the hooks having a generally arcuate shape and a straight portion, the generally arcuate shape portion defining an inside diameter and the straight portion being configured for sliding when in direct contact with the smooth planar top surface of the main bar; and an elongate hold-down bar of the hanger bar assembly, the hold-down bar having opposing ends and configured for being removably positioned with the main bar, the hold-down bar having a flat planar bottom surface configured for mating with the flat planar top surface of the main bar, the hold-down bar defining through holes positioned in the vicinity of the opposing ends, the main bar having a pair of resilient flexible tabs positioned in the vicinity of the opposing ends and extending outwardly from the main bar, the through holes of the hold-down bar being configured for the positioning of the tabs of the main bar therethrough, the flexible tabs being configured for bending transverse to the through holes for the securing of the hold-down bar in position on the main bar.

9. The hanger bar assembly of claim 8, wherein the main bar has rounded upper longitudinal edges.

10. The hanger bar assembly of claim 8, wherein the inside diameter of the generally arcuate hook is about 1.5 inches.

11. The hanger bar assembly of claim 8, wherein the thickness of the hanger is 5/32 of an inch and the separation between the slots is 0.5 inches.

12. The hanger bar assembly of claim 8, wherein the resilient tabs of the hold-down bar are metal.

13. The hanger bar assembly of claim 8, wherein the main bar has a width in the direction perpendicular to the longitudinal axis of approximately half of the inside diameter of the hanger hook, the slots in the main bar being separated by a distance of at least twice the thickness of the hanger hook, the distance of separation between the slots and the thickness of the main bar being configured for interfacing with the hook for the sliding of the hangers over the slots from one end to the opposing end during the loading of hangers.

14. A hanger bar assembly and a plurality of hangers configured for use in garment shipping boxes comprising:

hanger bar assembly including a main bar having a generally rectilinear shape and opposing ends, the opposing ends defining a longitudinal axis and being connected to mounting means for fitting over opposed top edges of a wardrobe carton so that the main bar spans across the top of the wardrobe carton, the main bar being fabricated of wood, having a smooth planar top surface, and defining a plurality of slots generally perpendicular to the longitudinal axis;

a plurality of hangers adapted for use with the hanger bar, each hanger including a hook configured for being positioned in one the slots of the main bar, the hooks having a generally arcuate shape and a straight portion, the generally arcuate shape portion defining an inside diameter and the straight portion being configured for sliding when in direct contact with the smooth planar top surface of the main bar, the main bar having a width in the direction perpendicular to the longitudinal axis of approximately half of the inside diameter of the hanger hook, the slots in the main bar being separated by a distance of at least twice the thickness of the hanger hook, the distance of separation between the slots and the thickness of the main bar being configured for interfacing with the flat portion and arcuate portion of the hook for the sliding of the hangers over the slots from one end to the opposing end during the loading of the hangers; and an elongate hold-down bar of the hanger bar assembly, the hold-down bar having opposing ends and configured for being removably-positioned with the main bar, the hold-down bar having a flat planar bottom surface configured for mating with the flat planar top surface of the main bar, the hold-down bar defining through holes positioned in the vicinity of the opposing ends, the main bar having a pair of resilient flexible tabs positioned in the vicinity of the opposing ends and extending outwardly from the main bar, the through holes of the hold-down bar being configured for the positioning of the tabs of the main bar therethrough, the flexible tabs being configured for bending transverse to the through holes for the securing of the hold-down bar in position on the main bar.

15. The hanger bar assembly of claim 11, the main bar has rounded upper longitudinal edges.

* * * * *